United States Patent [19]

Baker

[11] Patent Number: 4,755,726

[45] Date of Patent: Jul. 5, 1988

[54] XY DISPLAY TRANSITION INTENSIFIER

[75] Inventor: Daniel G. Baker, Aloha, Oreg.

[73] Assignee: Tektronix, Inc., Beaverton, Oreg.

[21] Appl. No.: 902,989

[22] Filed: Sep. 2, 1986

[51] Int. Cl.[4] ..... H01J 29/52

[52] U.S. Cl. ..... 315/386; 315/383; 358/168

[58] Field of Search ..... 315/383, 386; 358/168, 358/169

[56] References Cited

U.S. PATENT DOCUMENTS 4,198,661 4/1980 Gatten et al. ..... 315/386

4,325,009 4/1982 Andersen ..... 315/386

4,356,436 10/1982 Barten et al. ..... 315/386

*Primary Examiner*—Theodore M. Blum

*Attorney, Agent, or Firm*—Francis I. Gray

[57] ABSTRACT

An XY display transition intensifier increases the intensity of an electron beam of a CRT device when the deflection voltages are changing, indicating a transition between dots on the CRT display. The absolute values of the rate of change of the deflection voltages are determined and summed. The resulting output voltage is applied to the intensity grid of the CRT device to increase the intensity of the electron beam.

9 Claims, 1 Drawing Sheet

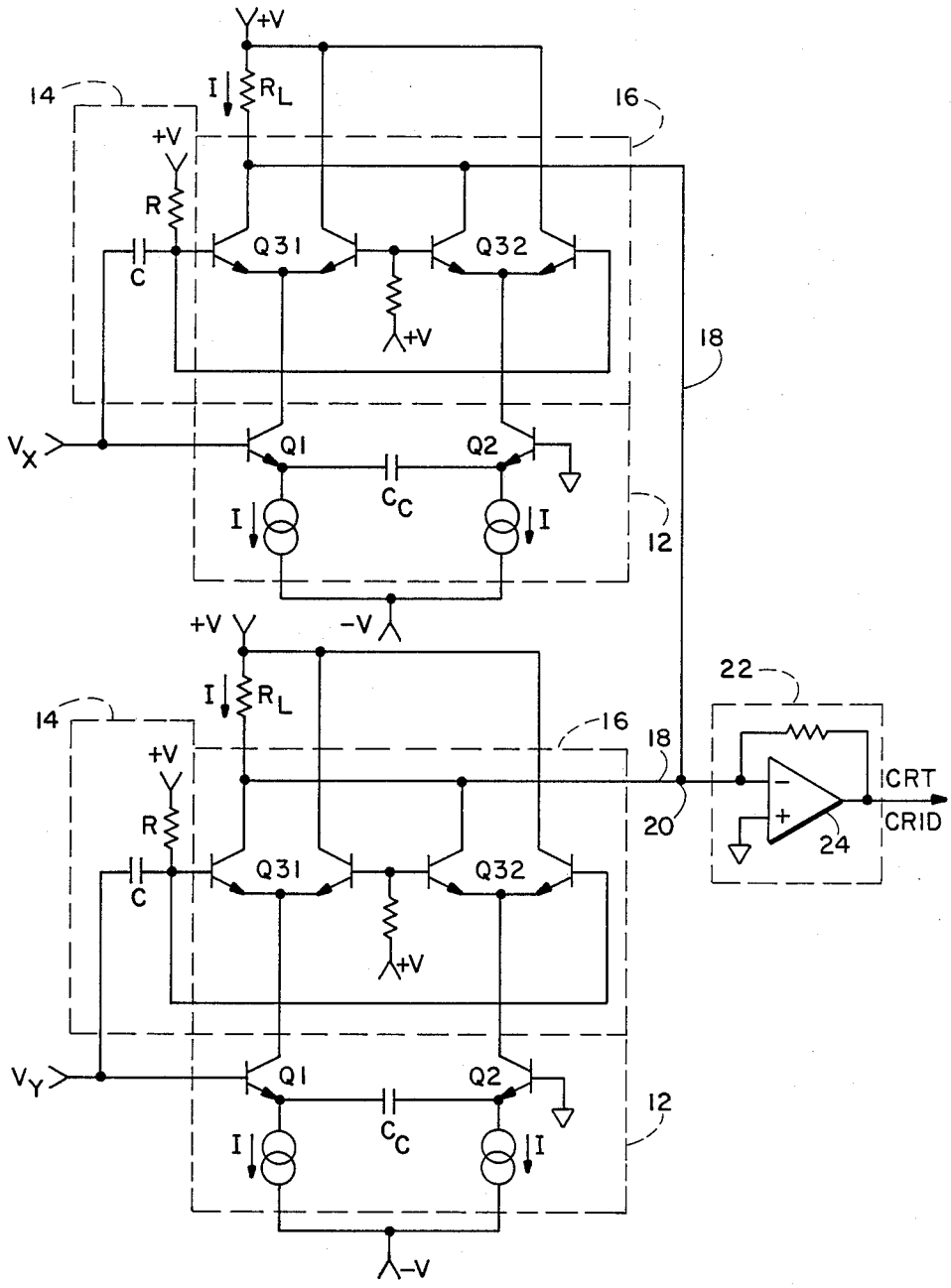
+V
I
$R_L$
14
16
+V
R
C
Q31
Q32
+V
18
$V_X$
Q1
Q2
$C_C$
I
I
12
+V
-V
22
I
$R_L$
14
16
18
+V
R
C
Q31
Q32
+V
20
CRT
CRID
24
$V_Y$
Q1
Q2
$C_C$
I
I
12
-V

XY DISPLAY TRANSITION INTENSIFIER

BACKGROUND OF THE INVENTION

The present invention relates to cathode ray tube (CRT) display, and more particularly to an XY display transition intensifier for a CRT display which equalizes the brightness between dots and the transition between the dots, the dots and transitions providing useful information.

In XY CRT displays, such as a vectorscope display, the displayed image is generated by applying signal voltages to the deflection plates of a CRT. When the voltages are momentarily constant the electron beam, which excites the screen phosphor of the CRT to produce the image, is stationary and a bright dot appears. Traditionally this is the only portion of the display image that is providing useful information. However the transitions between dots also are useful for relative timing information. Unfortunately the transitions are too dim to be easily seen when the dots are at normal brightness.

Therefore what is desired is a means for equalizing the brightness, or reducing the difference in brightness, between the dots and the transitions between dots.

SUMMARY OF THE INVENTION

Accordingly, the present invention provides an XY display transition intensifier which equalizes the brightness, or reduces the difference in brightness, between the dots and transitions between dots of a displayed image. Since the brightness of the transitions is a function of the electron beam speed, the beam speed is compensated for by taking the absolute value of the time derivative of the deflection signals, summing these values and applying the summed signal to the CRT grid to increase the transition brightness.

The objects, advantages and novel features of the present invention will be apparent from the following detailed description when read in conjunction with the appended claims and attached drawing.

BRIEF DESCRIPTION OF THE DRAWING

The FIGURE is a schematic view of an XY display transition intensifier according to the present invention.

DESCRIPTION OF THE PREFERRED EMBODIMENT

The brightness of the transitions between stationary dots on an XY CRT display is a function of the display duty cycle and the electron beam speed. The circuit shown in the FIGURE compensates for the electron beam speed by taking the absolute value of the time derivative of the X and Y deflection signals, $V_x$ and $V_y$, summing the two time derivative signals, and applying the sum signal to the intensity grid of the CRT to increase the transition brightness. Due to CRT gamma the exact correction would be obtained by the following expression:

$$V_g=(V_y^2+\dot{V}_y^2)^{\frac{1}{2}},$$

the gamma exponent being two. However, it has been determined empirically that the exact correction is not necessary. Therefore, the circuit of the FIGURE employs the following function:

$$V_o=/V_y/+/\dot{V}_y^2/.$$

The circuits for the horizontal and vertical deflection signals are identical, so only one of them will be described in detail. A pair of transistors $Q_1$, $Q_2$ act as a differentiator 12. For positive input transitions the collector current in the left transistor $Q_1$ increases and in the right transistor $Q_2$ decreases. The reverse occurs for negative transitions. Differential pairs of transistors $Q_{31}$, $Q_{32}$ are driven by an RC differentiator 14 and act as a switch 16 for the outputs of the differentiator 12, with the collector of the left transistor $Q_1$ being connected to the emitter pair of the left differential pair $Q_{31}$ and the collector of the right transistor $Q_2$ being connected to the emitter pair of the right differential pair $Q_{32}$. The transistors of switch 16 and differentiator 12 are available as a single, inexpensive multiplier integrated circuit from several integrated circuit vendors, such as the Motorola MC1496. The switch 16 routes the increasing current of the differentiator 12 through a common load RL for either a positive or negative transition. Thus the output current on line 18 is a function of the absolute value of the input rate of change. The outputs from the X and Y transition deflection circuits over lines 18 are summed at node 20 and input to a Z-axis driver 22, the output of which is applied to the CRT intensity grid to increase the intensity during transitions.

In operation so long as the deflection voltages $V_x$, $V_y$ are constant, i.e., a dot is being displayed on the CRT display, an equal bias voltage is applied to both bases of each differential transistor pair $Q_{31}$, $Q_{32}$ and each transistor of each pair conducts a current of I/2, resulting in an output current equal to I. When input deflection voltage changes positively, the left transistor $Q_1$ of the differentiator 12 is biased more positively, causing the emitter to increase in voltage. The increase of voltage at one emitter is transferred via a coupling capacitor $C_c$ to the emitter of the other transistor $Q_2$ which effectively reduces the bias of that transistor. Thus the current increases through $Q_1$ and decreases through $Q_2$. The positive going input voltage at the RC differentiator 14 causes the bias at the left transistor of the differential pair $Q_{31}$ to increase and conduct so that the increased current from $Q_1$ is switched through that transistor resulting in an output current equal to I plus a current proportional to $\dot{V}$, where $\dot{V}$ is the time derivative of the input deflection voltage. Likewise when the input voltage decreases, the current through $Q_2$ increases and the right transistor of the differential pair $Q_{32}$ has a decreased bias which cuts off that transistor and turns on the left transistor so that the increased current from $Q_2$ is switched to the output. Therefore, regardless of the direction of the change of the input voltage, the output voltage represents an absolute value representative of that rate of change.

The output currents from the two deflection circuits are input to an ope rational amplifier 24 at the inverting input, the non-inverting input being held at a fixed potential. The resulting output is an increased positive voltage from the Z-axis driver 22 when the deflection voltages are changing, i.e., during transitions, which results in increased intensity on the CRT display.

Thus the present invention provides an XY display transition intensifier which increases the intensity of the electron beam during changes in the deflection voltages regardless of the direction of the change by summing the absolute values of the rate of change and outputting the resultant to the intensity grid of a CRT display.

What is claimed is:

1. An XY display transition intensifier comprising:

means for differentiating a first deflection voltage to obtain a first time derivative value of the rate of change of the first deflection voltage; and means for switching the first time derivative value to a first output when the first deflection voltage changes to provide a first absolute value of the first time derivative value.

2. An XY display transition intensifier as recited in claim 1 further comprising:

means for differentiating a second deflection voltage to obtain a second time derivative value of the rate of change of the second deflection voltage;

means for switching the second time derivative value to a second output when the second deflection voltage changes to provide a second absolute value of the second time derivative value; and means for summing the first and second outputs to produce an intensity control voltage.

3. An XY display transition intensifier as recited in claim 1 wherein the first deflection voltage differentiating means comprises a first differentiator having two inputs and two outputs, the first deflection voltage being applied to one input and the other input being held at a fixed potential, the first time derivative value appearing at the outputs.

4. An XY display transition intensifier as recited in claim 3 wherein the first time derivative value switching means comprises:

a pair of first switches, one coupled to each output of the differentiator, the pair of first switches having a first common output as the first output; and a first switch differentiator to drive the pair of first switches, the first switch differentiator having the first deflection voltage coupled as an input and being coupled to the pair of first switches to provide the first absolute value at the first output.

5. An XY display transition intensifier as recited in claim 1 further comprising means for applying the first absolute value as an intensity control voltage for the XY display to increase the brightness of transitions between stationary dots.

6. An XY display transition intensifier as recited in claim 2 wherein the second deflection voltage differentiating means comprises a second differentiator having two inputs and two outputs, the second deflection voltage being coupled to one of the inputs and a fixed potential being coupled to the other input, the second time derivative value appearing at the outputs.

7. An XY display transition intensifier as recited in claim 6 wherein the second time derivative value switching means comprises:

a pair of second switches, one coupled to each output of the second differentiator, the pair of second switches having a second common output as the second output; and a second switch differentiator to drive the pair of second switches, the second switch differentiator having the second deflection voltage coupled as an input and being coupled to the pair of second switches to provide the second absolute value at the second output.

8. An XY display transition intensifier as recited in claim 2 further comprising means for applying the intensity control voltage to an intensity grid of the XY display device to increase the brightness of transitions between stationary dots.

9. A method of intensifying the brightness of transitions between stationary dots on an XY display comprising the steps of:

determining a time derivative for each orthogonal deflection signal of the XY display;

summing the time derivatives to form a sum signal; and applying the sum signal to an intensity grid of the XY display to increase the transition brightness.

* * * * *